United States Patent [19]

Jong

[11] Patent Number: 5,058,749

[45] Date of Patent: Oct. 22, 1991

[54] APPARATUS FOR SORTING ARTICLES ACCORDING TO SIZE

[75] Inventor: Jiunn-Neng Jong, Pingtung Hsien, Taiwan

[73] Assignee: Jung-Mei Jong Chiu, Pingtung Hsien, Taiwan

[21] Appl. No.: 540,475

[22] Filed: Jun. 19, 1990

[51] Int. Cl.[5] ..... B07C 1/04; B07C 5/04

[52] U.S. Cl. ..... 209/539; 198/394; 198/415; 198/786; 209/545; 209/586; 209/914; 209/934

[58] Field of Search ..... 209/539, 545, 586, 651, 209/652, 653, 654, 701, 910, 914, 917, 923, 934; 198/389, 394, 415, 461, 817, 786; 250/223 R

[56] References Cited

U.S. PATENT DOCUMENTS

| | | | |
|---|---|---|---|
| 2,534,362 | 12/1950 | Magnuson | 198/786 X |
| 2,813,617 | 8/1955 | Sheetz | 198/817 |
| 3,212,621 | 7/1961 | Daugherty | 198/817 X |
| 3,327,850 | 2/1965 | Simmons | 209/586 |
| 3,478,863 | 10/1967 | Fuchs | 198/389 |
| 3,653,509 | 12/1969 | Goodman, Jr. et al. | 198/817 X |
| 3,770,111 | 11/1973 | Greenwood et al. | 209/923 X |
| 3,774,040 | 11/1973 | Stephanos | 209/586 X |
| 4,901,842 | 2/1990 | Lemboke et al. | 198/415 |

FOREIGN PATENT DOCUMENTS 3644603 10/1987 Fed. Rep. of Germany ..... 209/910

*Primary Examiner*—Donald T. Hajec
*Assistant Examiner*—Joseph A. Kaufman
*Attorney, Agent, or Firm*—Ladas & Parry

[57] ABSTRACT

An apparatus for sorting articles according to size inlcudes a plurality of moving belt assemblies and an elongated hopper provided above the moving belt assemblies for feeding a plurality of articles to the same. The fed articles are aligned and spaced apart as they are transported along the moving belt assemblies. A light emitting device is adjacently disposed on one side of each movable belt assembly, and a photodetecting device is disposed opposite the light emitting device and adjacent to the other side of the movable belt assemblies. The articles cast shadows upon the photodetecting device as they move past the light emitting device. The photodetecting device transmits electrical signals corresponding to the sizes of the shadows which are received by a control circuit. The control circuit classifies the detected articles according to the transmitted electrical signals and actuates a plurality of electromagnetically operated push rods. Each of the push rods discharge a group of articles belonging to the same size range into one of a plurality of collector members.

7 Claims, 6 Drawing Sheets

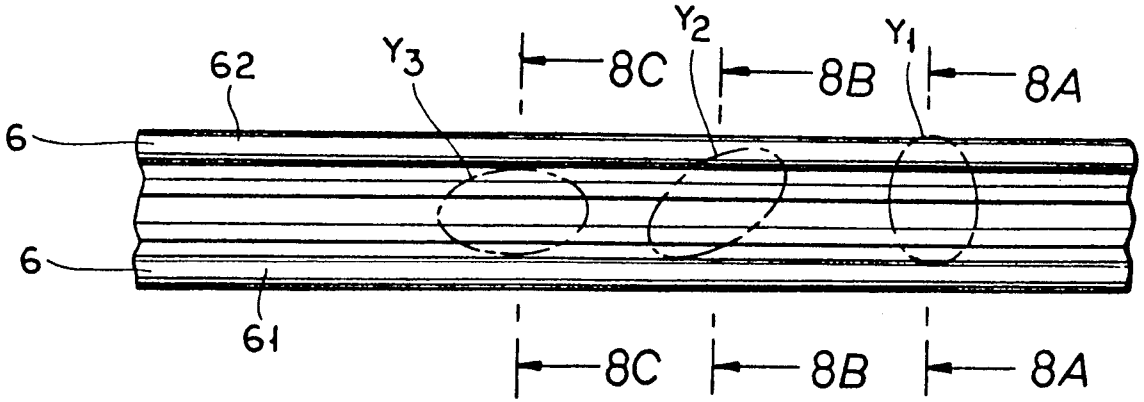
FIG. 7
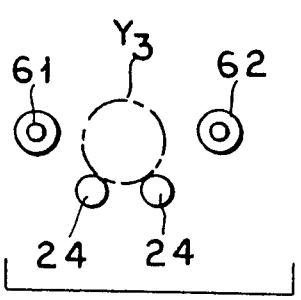
FIG. 8A
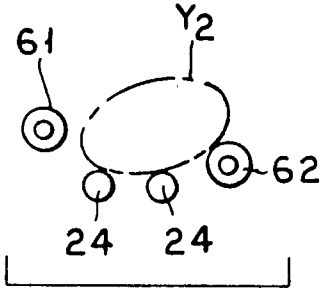
FIG. 8B
FIG. 8C

APPARATUS FOR SORTING ARTICLES ACCORDING TO SIZE

BACKGROUND OF THE INVENTION

This invention relates to an apparatus for sorting articles, more particularly to an apparatus for sorting articles according to size.

At present, the grouping and sorting of articles such as foodstuffs according to specific size ranges is a manual operation. This entails huge labor costs because of the large amount of manpower required. Inconsistencies in speed and accuracy are also encountered as a result of factors related to mental and physical fatigue.

SUMMARY OF THE INVENTION

Therefore, the objective of this invention is to provide an automated sorting apparatus which requires little manpower, thus reducing labor costs.

A second object of this invention is to provide an automated sorting apparatus which is relatively fast, efficient, and has a high degree of accuracy, thereby increasing the production output.

Accordingly, a sorting apparatus of this invention comprises a plurality of moving belt assemblies, means provided above the moving belt assemblies for feeding a plurality of articles onto the same, means for aligning the fed articles on the moving belt assemblies, means for detecting the size of each aligned article and transmitting electrical signals corresponding to the detected size, means for spacing articles upstream from the detecting means, a control means for receiving the transmitted electrical signals and classifying the detected articles according to the transmitted electrical signals, a plurality of collector members, and means actuated by the control means for discharging the articles into one of the collector members.

Each of the moving belt assemblies comprises a first main roller, a first secondary roller, a pair of first endless belts rotatably interconnecting the first main roller and the first secondary roller, and driving means for rotating said first main roller.

The spacing means comprises a second secondary roller provided upstream of the detecting means and having a first annular depression for receiving the first endless belts. The second secondary roller further has an annular projection protruding from the first annular depression and moving at a velocity slower than that of the first endless belts. After the articles have been aligned on the moving belt assemblies, the annular projection instantaneously slows down the articles which are moving from the first endless belts to the annular projection. As the articles move from the annular projection to the first endless belts, the velocity of the articles is once more increased, thereby resulting in the spacing of the articles.

The detecting means comprises a light emitting means adjacently disposed on one side of each of the movable belt assemblies, and a photodetecting means disposed opposite the light emitting means and adjacent to the other side of the movable belt assemblies. The articles cast shadows upon the photodetecting means as they move past the light emitting means. The photodetecting means transmits electrical signals corresponding to the sizes of the shadows.

The discharging means comprises a plurality of electromagnetically operated push rods actuated by the control means. Each of the push rods discharge a group of articles belonging to the same size range into one of the collector members.

BRIEF DESCRIPTION OF THE DRAWINGS

Other features and advantages of this invention will become apparent in the following detailed description of the preferred embodiment with reference to the accompanying drawings, in which:

FIG. 7 is a top schematic operational illustration of a second embodiment of an aligning means for the sorting apparatus according to this invention;

FIGS. 8A, 8B and 8C are sectional views of the aligning means shown in FIG. 7;

DETAILED DESCRIPTION OF THE PREFERRED EMBODIMENT

Figure 1:
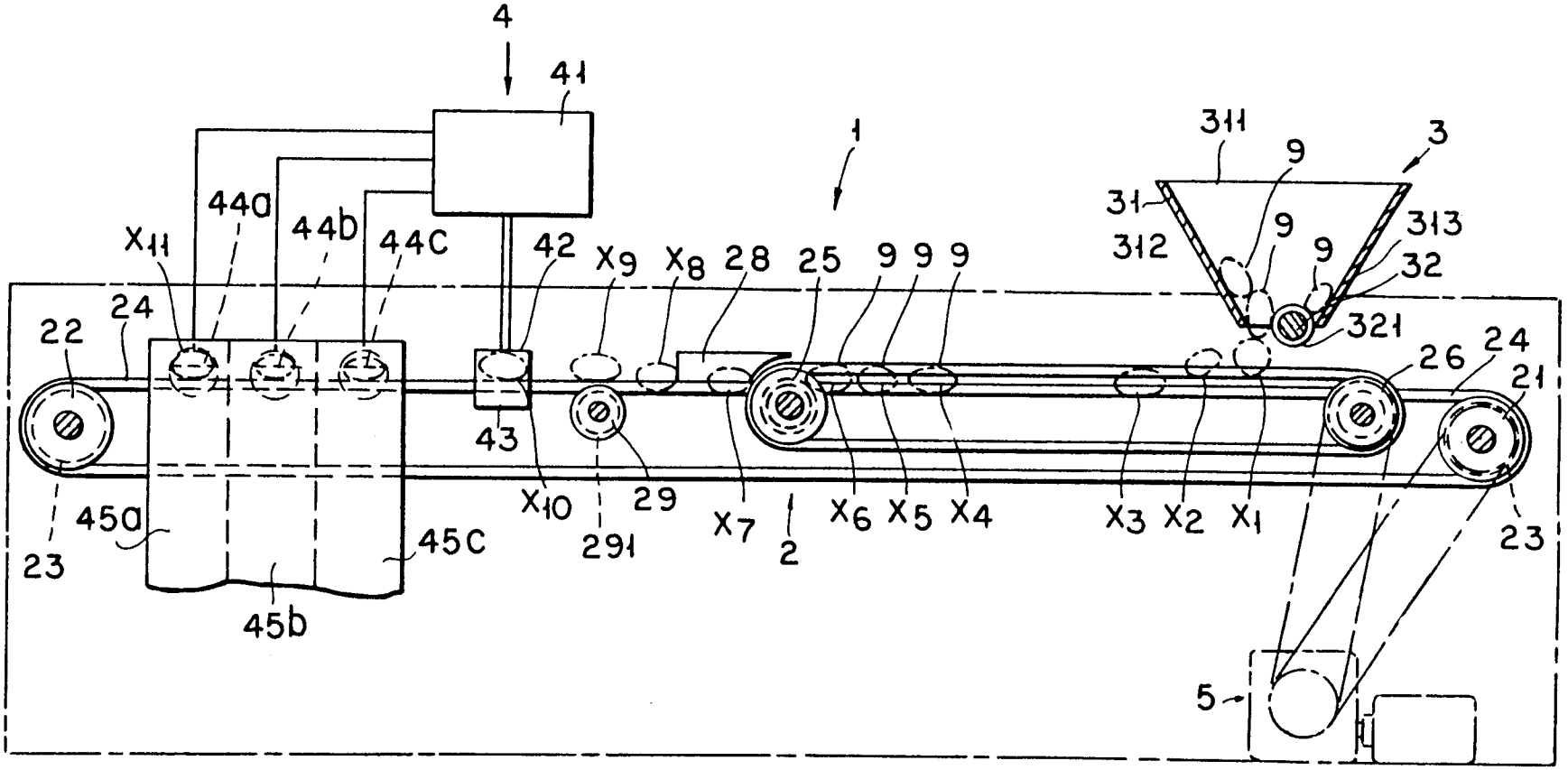
FIG. 1 is a front schematic operational illustration of a sorting apparatus according to this invention.
Figure 2:
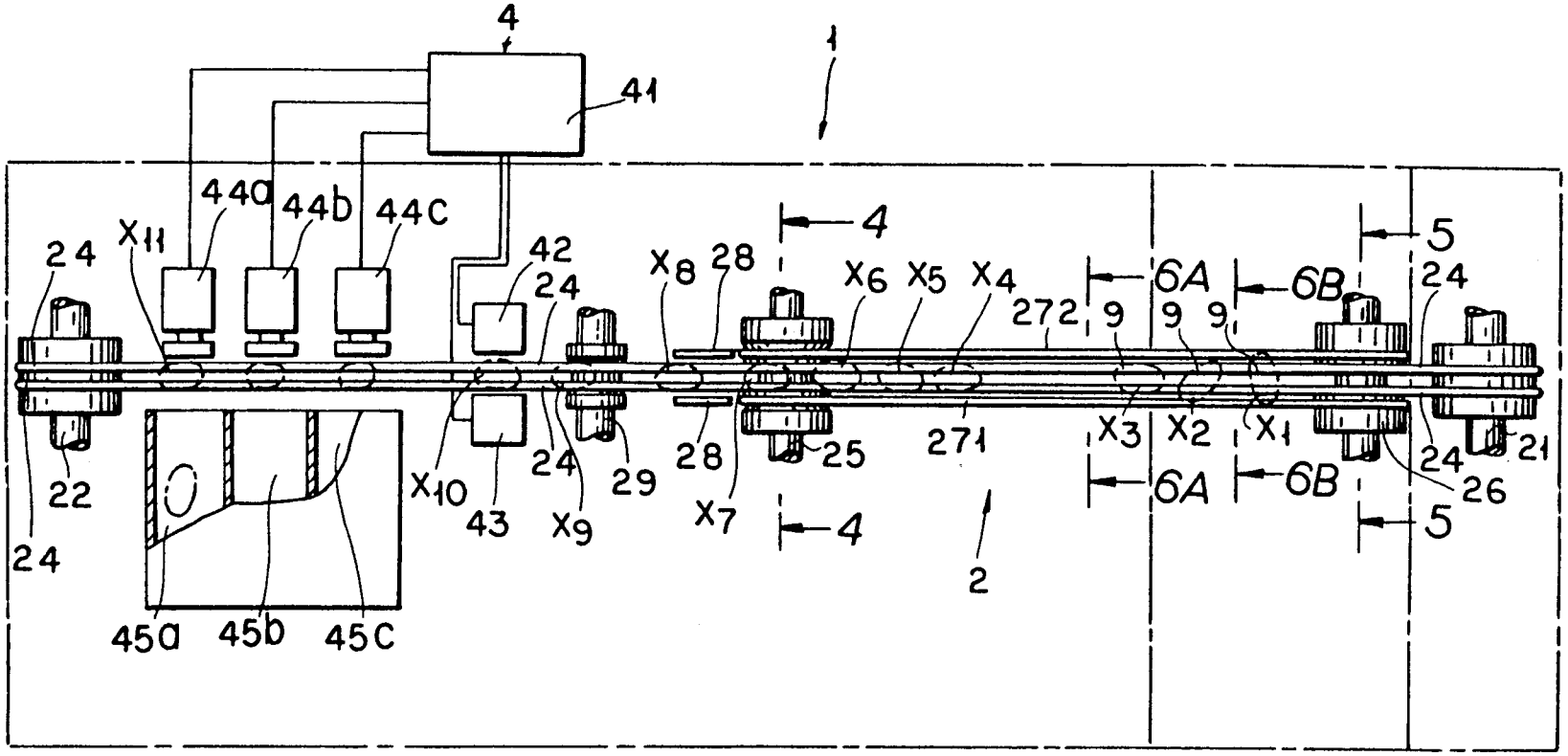
FIGS. 2 and 3 are top schematic operational illustrations of the preferred embodiment.
Figure 3:
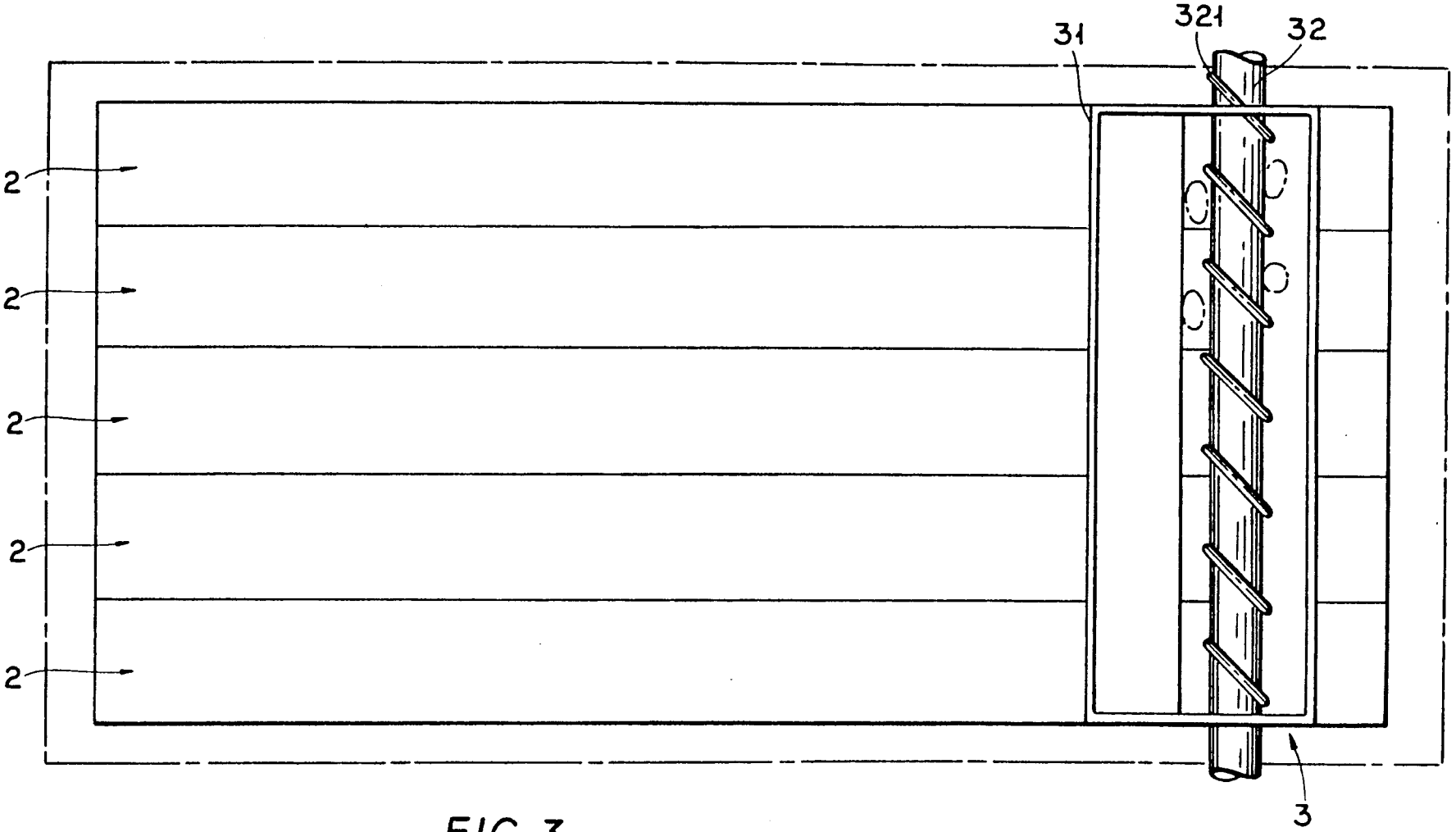

FIG. 1 and FIGS. 2 and 3 are front and top schematic illustrations, respectively, showing the flow of operation of the preferred embodiment of a sorting apparatus according to this invention. A moving belt assembly 2 is mounted on top of a machine frame 1. An article feeding means 3 is installed near and above an extreme end of the moving belt assembly 2. A control means 4 is similarly installed above the moving belt assembly 2 near a second extreme end opposite the article feeding means 3. A plurality of articles 9 fall from the article feeding means 3 onto the moving belt assembly 2. The moving belt assembly 2 transports the articles 9 to the control means 4 where they are classified and collected according to size. A driving means 5 is installed on a base end of the machine frame 1 and is used to operate the moving belt assembly 2.

The article feeding means 3 comprises a hopper 31 and a rotating shaft 32. The hopper 31 is shaped as an elongated trough and has an upper open end 311 used as an inlet for the articles 9 and a lower outlet end 312 for the articles 9. The rotating shaft 32 is longitudinally disposed at the lower outlet end 312 near an inclined wall 313 of the hopper 31, thus reducing the size of the outlet opening for the articles 9. The rotating shaft 32 is in constant rotation to avoid aggregation and blockage and to discharge a constant flow of the articles 9. The rotating shaft 32 has a helical screw thread 321 extending along its length. The helical screw thread 321 regulates the flow of the articles 9 out of the hopper 31 so that they may be easily and properly distributed on the moving belt assembly 2. As shown in FIG. 3, the preferred embodiment actually comprises a plurality of moving belt assemblies 2 which receive the articles 9 from the hopper 31. However, for the purpose of simplifying the operational description of the preferred embodiment, only the operation of one moving belt assembly 2 will be described.

The moving belt assembly 2 has a main roller 21 and a secondary roller 22 disposed on opposite ends of the moving belt assembly 2. The main roller 21 and the secondary roller 22 each have a pair of spaced annular grooves 23 and are rotatably interconnected by a pair of endless belts 24 received in the annular grooves 23. As shown in FIGS. 1 and 2, eleven articles 9, which are numbered from X1 to X11, are advanced to different positions on the moving belt assembly 2 to aid in the explanation of the operation of the preferred embodiment.

If one of the articles 9 which fell from the hopper 31 has a size that is smaller than the spacing between the endless belts 24, the article 9 will not be transported by the endless belts 24, but would instead fall through the spacing between the endless belts 24 where it will eventually be collected. The moving belt assembly 2 also includes a second main roller 26 installed downstream from the main roller 21 below the hopper 31 and a second secondary roller 25 disposed between the second main roller 26 and the secondary roller 22.

Figure 4:
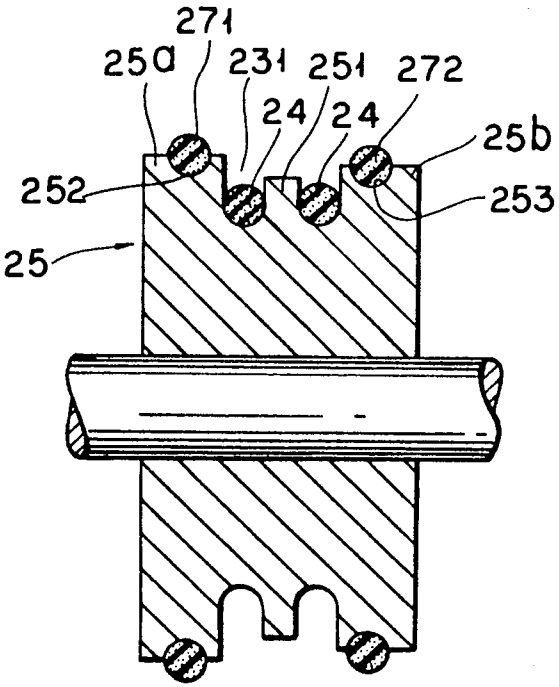

FIG. 4 is sectional view of the second secondary roller 25 shown in FIG. 2. The second secondary roller 25 has a first and a second annular flange, 25*a* and 25*b*, which confine an annular depression 231. An annular projection 251 protrudes between the first and second annular flanges 25*a* and 25*b* in the annular depression 231. The first and second annular flanges 25*a* and 25*b* respectively have an annular groove 252 and 253. The diameter of the first annular flange 25*a* is wider than the second annular flange 25*b*.

Figure 5:
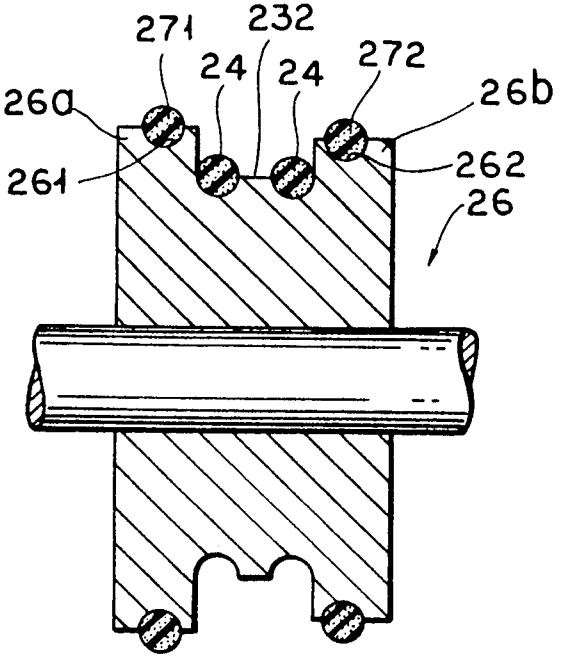
FIGS. 4, 5, 6A and 6B are sectional views of the sorting apparatus shown in FIG. 2.

FIG. 5 is a sectional view of the second main roller 26 shown in FIG. 2. The second main roller 26 similarly has a first and a second annular flange, 26*a* and 26*b*, which confine an annular depression 232. The first and second annular flanges 26*a* and 26*b* respectively have an annular groove 261 and 262. A second and a third endless belt, 271 and 272, are respectively received in the annular grooves 261 and 262 of the second main roller 26 and in the annular grooves 252 and 253 of the second secondary roller 25 to rotatably interconnect the second main roller 26 and the second secondary roller 25. As with the second secondary roller 25, the diameter of the first annular flange 26*a* is wider compared to that of the second annular flange 26*b*.

Referring once more to FIG. 1, the second main roller 26 is rotated by the driving means 5. The endless belts 24 are received in the annular depressions 231 and 232 of the second main roller 26 and the second secondary roller 25. The annular projection 251 partitions the endless belts 24 at the second secondary roller 25.

The main roller 21, the secondary roller 22, the second main roller 26, and the second secondary roller 25 are arranged in such a manner that the second endless belt 271 has the fastest velocity, followed by the third endless belt 272 and the pair of endless belts 24. The velocity at the annular projection 251 is designed to be slower than that of the endless belts 24.

Figure 6B:
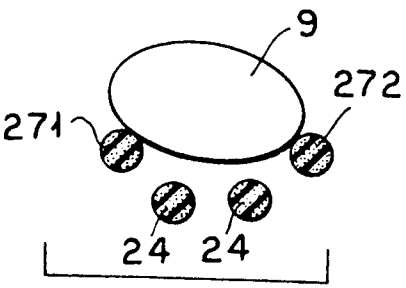
Figure 6A:
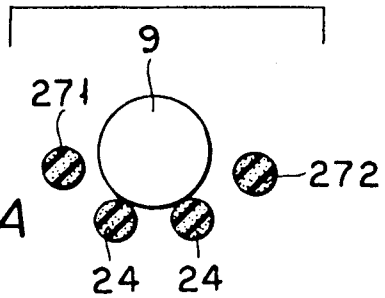

FIGS. 6A and 6B are sectional views of the moving belt assembly 2 illustrating the operation of the second and third endless belts 271 and 272. As shown in FIG. 6A, if one of the articles 9 which fell from the hopper 31 has a substantially round cross-section, the article 9 would be transported towards the control means 4 by the endless belts 24 regardless of its position on the same. If the article 9 which fell from the hopper 31 is substantially oblongated, as shown in FIG. 6B, the article 9 will come into contact with one or both of the second and third endless belts 271 and 272.

Referring once more to FIGS. 1 and 2, the articles X1, X2, and X3 are substantially oblongated bodies and thus came into contact with the second and third endless belts 271 and 272 after falling from the hopper 31. Because of the difference in the velocities of the second and third endless belts 271 and 272, the portion of the article 9 resting on the second endless belt 271 is transported ahead of the portion resting on the third endless belt 272, as illustrated by the article X2. Further transportation of the article 9 by the second and third endless belts 271 and 272 will eventually align the article 9, as shown by the article X3, with the endless belts 24 and thus causing the article 9 to be transported by the endless belts 24.

Therefore, the main purpose of the second and third endless belts 271 and 272 is to align the articles 9 with the endless belts 24 and to cause the articles 9 to be transported by the endless belts 24 to prepare the articles 9 for classification.

Referring again to FIGS. 1, 2, and 4, as the articles 9 approach the second secondary roller 25, which is shown by the articles X4, X5 and X6, the annular projection 251 instantaneously slows down the articles 9 which are moving from the endless belts 24 to the annular projection 251 due to the difference in the velocities of the annular projection 251 and the endless belts 24. As the articles 9 move from the annular projection 251 to the endless belts 24, the velocity of the articles 9 is once more increased. This results in the spacing of the articles 9, as shown by the articles X7, X8, and X9, and facilitates the classification thereof. A pair of opposing guide plates 28 are installed adjacent to the endless belts 24 immediately after the second secondary roller 25. This is to prevent the articles 9 from falling off the endless belts 24 because of the abrupt change in the velocity of the articles 9.

The moving belt assembly 2 further includes a restricting roller 29 installed between the guide plates 28 and the control means 4. The restricting roller 29 similarly has a pair of annular grooves 291 for receiving the endless belts 24. The spacing between the annular grooves 291, however, is smaller than the spacing between the annular grooves 23 of the main roller 21 and the secondary roller 22. The space between the endless belts 24 at points between the second secondary roller 25 and the restricting roller 29 is therefore gradually restricted (as shown in FIG. 2). The purpose for restricting the spacing between the endless belts 24 will become evident in the following paragraphs.

The control means 4 comprises a central processing unit 41, a light emitting means 42, a photodetecting means 43, three discharging means 44*a*, 44*b* and 44*c*, and three collector members 45*a*, 45*b*, 45*c*. The light emitting means 42 and the photodetecting means 43 are oppositely disposed on two sides of the moving belt assembly 2 adjacent the endless belt 24 after the restricting roller 29. As the article 9, illustrated by article X10, is transported between the light emitting means 42 and the photodetecting means 43, the article X10 casts a shadow upon the photodetecting means 43. The shadow cast upon the photodetecting means 43 is a representative of the widest cross-sectional area of the article X10. It is therefore necessary to restrict the spacing between the endless belts 24 to raise the articles 9 and reduce the size of any portion of the articles 9 extending into the area between the endless belts 24 which, if unaccounted for, might substantially affect the dimensions of the shadows. The photodetecting means 43 transmits electrical signals to the central processing unit 41 which correspond to size of the shadows of the articles 9. Since the structure of the light emitting means 42 and the photodetecting means 43 are known in the art, the light emitting means 42 and the photodetecting means 43 will not be described in great detail herein.

The information received by the central processing unit 41 allows the central processing unit 41 to calculate the approximate area of the shadow and thus classify the article 9 as belonging to one of three groups. (The assumption here is that the volume of the article 9 is proportional to its cross-sectional area). The central processing unit 41 then actuates one of the discharging means 44*a*, 44*b* or 44*c*, to push the article 9 off the endless belts 24 and into one of the collector members 45*a*, 45*b*, or 45*c*. Each of the discharging means 44*a*, 44*b*, and 44*c* is an electromagnetically operated push rod actuated by the control means 4. As shown in FIGS. 1 and 2, the central processing unit 41 actuates the discharging means 44*a* to push the article X11 into the collector bin 45*a*.

If the article 9 is not classified by the central processing unit 41 as a member of any of the three groups, the article 9 is transported by the moving belt assembly 2 to the secondary roller 22 where it would eventually fall off and be collected by a fourth collector bin (not shown).

The control means 4 described in the preceding paragraphs can be extended to sort the articles 9 into more than 20 groups. The description of the preferred embodiment, however, speaks only of three groups for the sake of simplicity.

The means for aligning the articles 9 on the endless belts 24 is not limited to the use of the second and third endless belts 271 and 272. Referring to FIG. 7, elongated guiding means 6 extend along a portion of the moving belt assembly 2 adjacent the endless belts 24. The guiding means 6 comprises a first level guide shaft 61 which extends longitudinally between the main roller 21 and the second secondary roller 25, and a second inclined guide shaft 62 extending opposite the first level guide shaft 61 and similarly adjacent to a portion of the endless belts 24 between the main roller 21 and the second secondary roller 25. The second inclined guide shaft 62 inclines upward from the upstream side to a downstream side of the endless belts 24.

FIGS. 8A, 8B and 8C are sectional views taken at different portions of the assembly shown in FIG. 7. One of the articles 9 is shown in three different portions, indicated by Y1, Y2 and Y3, of the assembly to illustrate the different stages of alignment. The article 9 is initially transverse to the endless belts 24, as shown in FIG. 8A. The second inclined guide shaft 62 is in contact with one end of the article 9 and raises the level of the same relative to the endless belts 24, as shown in FIG. 8B. The difference in the velocities of the surfaces of contact of the article 9, and the inclination of the second inclined guide shaft 62 help align the article 9 on the endless belts 24. The article 9, as shown in FIG. 8C, is properly aligned with the endless belts 24 and undergoes the same process undergone by the article X3 of FIGS. 1 and 2.

Figure 9:
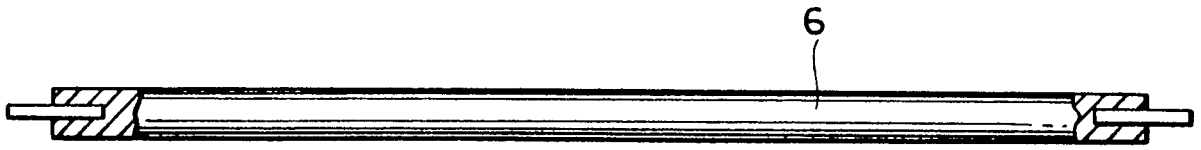
FIG. 9 is a front partly sectional view of the aligning means shown in FIG. 7.

Referring to FIG. 9, the constructions of the first level guide shaft 61 and the second inclined guide shaft 62 allow them to rotate along their respective axis. The rotation of the first level guide shaft 61 and the second inclined guide shaft 62 considerably reduces the amount of friction between the guiding means 6 and the articles 9.

Figure 10:
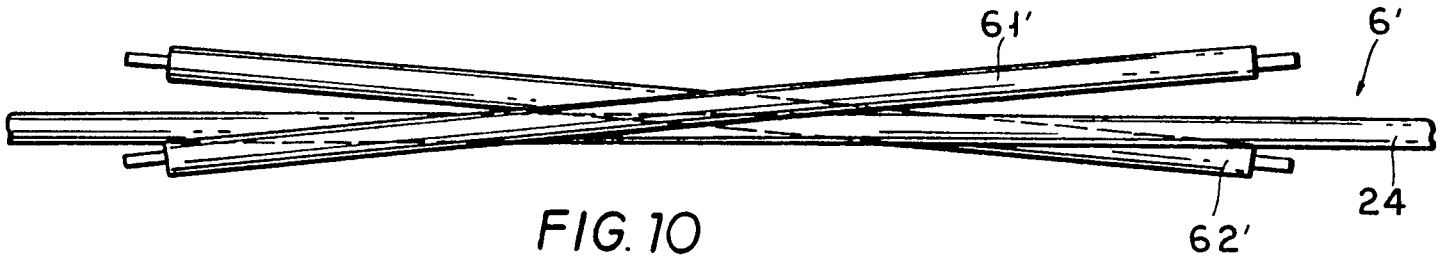
FIG. 10 is a front schematic illustration of a third embodiment of an aligning means for the sorting apparatus of this invention.

Referring to FIG. 10, a second preferred embodiment of an aligning means 6′ comprises a pair of oppositely inclining guide shafts 61′ and 62′ which extend adjacent to opposite sides of a portion of the endless belts 24 between the main roller 21 and the second secondary roller 25. The aligning means 6′ similarly achieves the effect of reducing the amount of friction between the article 9 and the aligning means 6′.

The main advantages of the sorting apparatus of this invention are as follows:

(a) Little manpower is required, thereby reducing labor cost.

(b) The apparatus is fast, efficient and accurate, thereby increasing production.

(c) The apparatus can be used to sort a wide variety of articles. The apparatus therefore has a wide range of applications.

(d) Since the apparatus is automated, less supervision is required.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An apparatus for sorting articles according to size, comprising:

a moving belt assembly, said moving belt assembly comprising a first main roller having a pair of spaced first annular grooves; a first secondary roller having a pair of spaced annular grooves; a pair of first endless belts rotatably interconnecting said first main roller and said first secondary roller, said first endless belts being received in said first and second annular grooves; and a driving means for rotating said first main roller;

means for feeding a plurality of articles to said moving belt assembly, said feeding means being provided above said moving belt assembly;

means for aligning said fed articles on said moving belt assembly;

means for detecting the size of each said aligned article and transmitting electrical signals corresponding to said detected size;

means for spacing articles upstream of said detecting means, said spacing means comprising a second secondary roller provided upstream of said detecting means and having a first and second annular flange which confine a first annular depression therebetween for receiving said first endless belts, said second secondary roller further having an annular projection protruding from said first annular depression and separating said first endless belts in said first annular depression, said annular projection moving at a velocity slower than that of said first endless belts so that said annular projection instantaneously slows down said articles transported by said first endless belts;

a control means for receiving said electrical signals and classifying said detected articles according to said electrical signals;

a plurality of collector members; and means actuated by said control means for discharging said articles into one of said collector members in accordance with how said articles were classified by said control means.

2. An apparatus as claimed in claim 1, wherein each of said first and said second annular flanges has an annular groove, said first annular flange having a diameter which is wider than the diameter of said second annular flange; said aligning means comprising:

a second main roller adjacent said first main roller, said second main roller having a third and a fourth annular flange which confine a second annular depression therebetween for receiving said first endless belts, each of said third and said fourth annular flanges similarly having an annular groove, said third annular flange having a diameter which is wider than the diameter of said fourth annular flange, said driving means rotating said second main roller;

a second endless belt received in said annular grooves of said first and said third annular flanges; and a third endless belt received in said annular grooves of said second and said fourth annular flanges;

said second endless belt having a faster velocity than said third endless belt;

said third endless belt having a faster velocity than said first endless belts.

3. An apparatus as claimed in claim 2, wherein said spacing means further comprises a pair of opposing guide plates installed adjacent said first endless belts immediately after said second secondary roller to prevent said articles from falling off said first endless belts as a result of abrupt changes in the velocities of said articles.

4. An apparatus as claimed in claim 1, wherein said aligning means comprises:

a first level guide shaft extending longitudinally and adjacent to a portion of said first endless belts between said main roller and said second secondary roller; and a second inclined guide shaft extending opposite said first level guide shaft and adjacent to a portion of said first endless belts between said main roller and said second secondary roller, said second inclined guide shaft inclining upward from an upstream side to a downstream side of said first endless belts.

5. An apparatus as claimed in claim 4, wherein each of said first level guide shaft and said second inclined guide shaft is rotatable.

6. An apparatus as claimed in claim 1, wherein said aligning means comprises a pair of oppositely inclining guide shafts extending adjacent to a portion of said first endless belts between said main roller and said second secondary roller on opposite sides of the same.

7. An apparatus, for sorting articles according to size, comprising:

a moving belt assembly said moving belt assembly comprising a main roller having a pair of spaced first annular grooves; a secondary roller having a pair of spaced second annular grooves; a pair of first endless belts rotatably interconnecting said main roller and said secondary roller, said first endless belts being received in said first and second annular grooves; driving means for rotating said main roller; and a restricting roller installed between said main roller and said secondary roller near said detecting means, said restricting roller having a pair of annular grooves for receiving said first endless belts, said spacing between said annular grooves of said restricting roller being slightly smaller than the spacing between said first annular grooves and said second annular grooves, said restricting roller reducing the space between said first endless belts so as to reduce the size of any portion of said articles extending into the area between said first endless belts when said articles are being detected;

means for feeding a plurality of articles to said moving belt assembly, said feeding means being provided above said moving belt assembly;

means for aligning said fed articles on said moving belt assembly;

means for detecting the size of each said aligned articles and transmitting electrical signals corresponding to said detected size;

means for spacing articles upstream of said detecting means;

a control means for receiving said electrical signals and classifying said detected articles according to said electrical signals;

a plurality of collector members; and means actuated by said control means for discharging said articles into one of said collector members in accordance with how said articles were classified by said control means.

* * * * *